United States Patent [19]

Matthews

[11] Patent Number: 4,856,440

[45] Date of Patent: Aug. 15, 1989

[54] LINKING MACHINE

[75] Inventor: Denis Matthews, Sutton-in-Ashfield, England

[73] Assignee: Mathbirk Limited, Sutton-in-Ashfield, England

[21] Appl. No.: 230,599

[22] Filed: Aug. 10, 1988

[51] Int. Cl.[4] ..... D05B 7/00

[52] U.S. Cl. ..... 112/27

[58] Field of Search ..... 112/25, 27

[56] References Cited

U.S. PATENT DOCUMENTS

| | | | |
|---|---|---|---|
| 3,696,764 | 10/1972 | Merkle | 112/25 |
| 4,197,802 | 4/1980 | Matthews | 112/27 |
| 4,393,799 | 7/1983 | Matthews | 112/27 X |

FOREIGN PATENT DOCUMENTS

| | | | |
|---|---|---|---|
| 2057367 | 5/1972 | Fed. Rep. of Germany | 112/27 |
| 2509446 | 9/1975 | Fed. Rep. of Germany | 112/27 |

*Primary Examiner*—Ronald Feldbaum

*Attorney, Agent, or Firm*—Lorusso & Loud

[57] ABSTRACT

A fabric feed-on apparatus for a linking machine having a rotatable dial of points, the device including a fabric push-on device operable to push fabric onto and down the shanks of the points during rotation of the dial of points, and a fabric uncurling device movably mounted for movement between an operative position and an inoperative position, the uncurling device in said operative position being located adjacent to and upstream of the push-on device so as to be able to guide and uncurl fabric edges to the push-on device during rotation of the dial of points to thereby cause the fabric edges to be impaled on the points, the uncurling device in said inoperative position being located at a remote stowed location so as to provide clear access to the dial of points. The push on device preferably comprises a plurality of spaced fingers arranged side by side by side on a movable support, the fingers being arranged in used to be moved along a path passing in board of the terminal end of the points such that each finger passes between an adjacent pair of points to thereby push fabric located on those points down their shanks.

14 Claims, 3 Drawing Sheets

LINKING MACHINE

The present invention relates to a linking machine.

Linking machines are widely used for joining together of knitted fabrics, primarily in the production of garments. When joining knitted fabrics edge to edge it is possible to encounter two different types of problems depending on whether the fabrics are to be joined along a raw edge (i.e. an edge having unprotected knitted loops) or along a selvedge.

In general raw edges are prone to unravelling and tend to lie flat. In addition, since such raw edges normally extend in the course wise direction of the fabric they are prone to a substantial amount of stretch. This presents a certain criteria for feeding raw edged fabric onto the points of the linking machine. By contrast selvedges present a different criteria for feeding onto the points of the linking machine since they are stable against unravelling but tend to curl and so have to be straightened prior to presentation to the points of the linking machine. In addition since selvedges extend generally in the walewise direction of the fabric they only possess a limited amount of stretch compared with the raw edges.

In view of the different criteria for joining together raw edges and selvedges of knitted fabrics, garment manufacturers have utilised two different machines, one for joining raw edges and one for joining selvedges.

A general aim of the present invention is to provide a fabric feed-on apparatus for a linking machine which enables the linking machine to function to join raw edges or selvedges. Thus such a fabric feed-on apparatus enables a garment manufacturer to utilise a single machine and one operative for joining raw edges and selvedges whereas previously two machines and two operatives had been necessary.

According to one aspect of the present invention there is provided a fabric feed-on apparatus for a linking machine having a rotatable dial of points, the device including a fabric push-on device operable to push fabric onto and down the shanks of the points during rotation of the dial of points, and a fabric uncurling device movably mounted for movement between an operative position and an inoperative position, the uncurling device in said operative position being located adjacent to and upstream of the push-on device so as to be able to guide and uncurl fabric edges to the push-on device during rotation of the dial of points to thereby cause the fabric edges to be impaled on the points, the uncurling device in said inoperative position being located at a remote stowed location so as to provide clear access to the dial of points.

According to another aspect of the invention there is provided a fabric feed-on apparatus for a linking machine having a rotatable dial of points, the device including a fabric push-on device operable to push fabric onto and down the shanks of the points during rotation of the dial of points, the push-on device comprising a rotatable disc having a circumferential periphery for engaging said fabric to push the fabric onto and down the shanks of the points, and a fabric uncurling device located adjacent to and upstream of the push-on device so as to be able to guide and uncurl fabric edges to the periphery of said disc to thereby maintain the edges in an uncurled condition and cause them to be impaled on the points.

According to a further aspect of the present invention there is provided a device for running fabric down the shank of points on a linking machine, the device including a plurality of spaced fingers arranged side by side on a movable support, the fingers being arranged in use to be moved along a path passing in board of the terminal end of the points such that each finger passes between an adjacent pair of points to thereby push fabric located on those points down their shanks.

Various aspects of the present invention are hereinafter described with reference to the accompanying drawings, in which.

Figure 1:
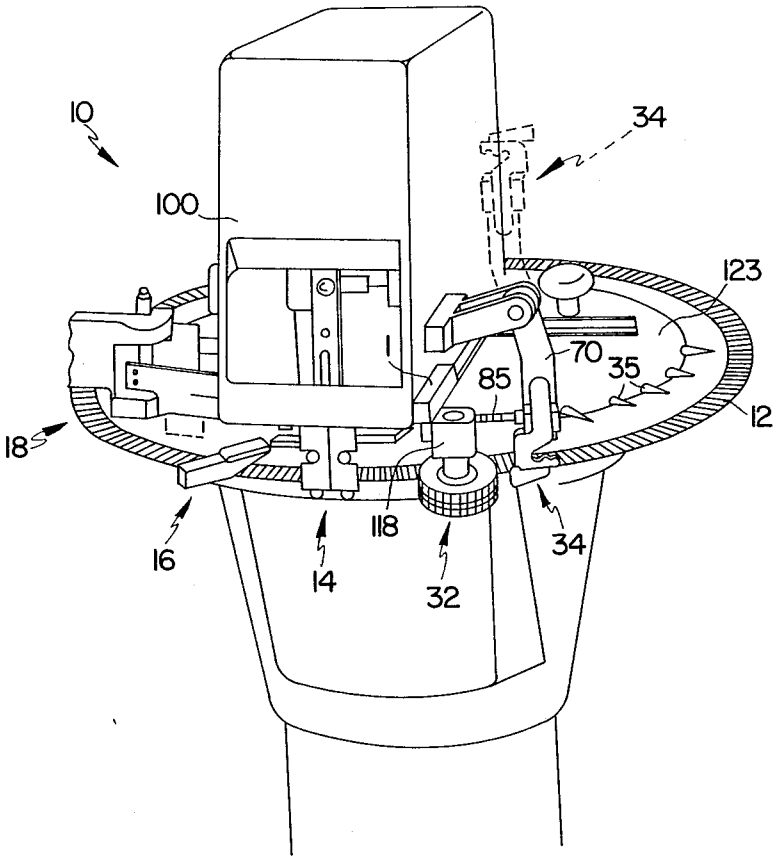
FIG. 1 is a schematic perspective view of part of a linking machine including a fabric feed apparatus according to the present invention.

Referring initially to FIG. 1 there is shown a linking machine 10 having a rotatable dial of points 12. Knitted fabric to be joined is impaled upon the points 12 and is then conveyed thereby in succession to a first sewing station 14 whereat a joining seam is formed, preferably by a pair of needles each producing an independent row of chain stitches. The fabrics are then conveyed by the points to a trimming station 16 whereat excess fabric above the joining seam is removed. The fabrics are then conveyed to a second sewing station 18 whereat an oversew seam is produced by a single or a pair of needles.

A linking machine of the above type is described in our U.K. Patent Nos. 1506575, 1520637, 1564771 and 1592198 and reference should be made thereto.

A fabric feed device according to the present invention is generally illustrated at 30 and includes a fabric push-on device 32 and an uncurling guide device 34. The uncurling device 34 is movable between an operative position as shown in solid lines in FIG. 1 and an inoperative, stowed position as illustrated in broken lines in FIG. 1.

Figure 2:
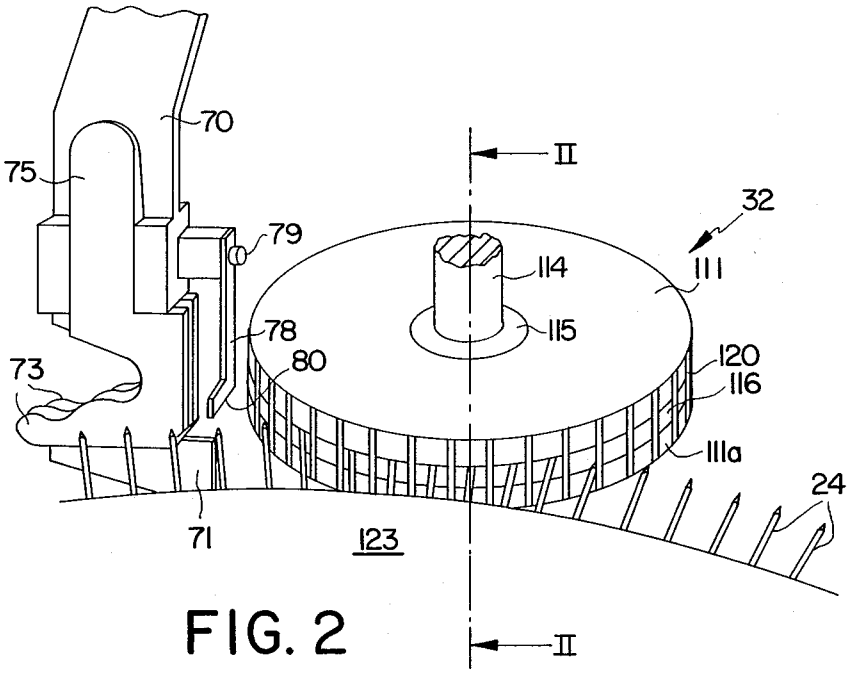
FIG. 2 is a more detailed part perspective view of the fabric feed apparatus of the present invention.
Figure 3:
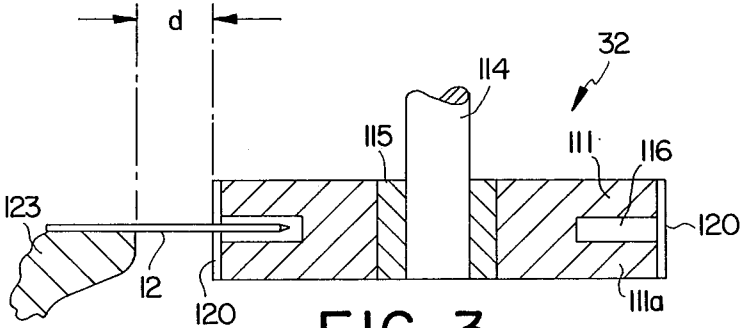
FIG. 3 is a sectional view taken along line II—II in FIG. 2.

The fabric push-on device 32 is more clearly illustrated in FIGS. 2 and 3 and includes a disc 111 which is rotatably mounted on a shaft 114 via a bearing 115.

The shaft 114 is mounted in a support 118 which is in turn mounted on a fixed part 1 of the linking machine, for instance the housing 100 forming part of the first sewing station 14. The disc 111 includes a circumferentially extending groove 116 and a plurality of axially extending fingers 120 are provided which are spaced circumferentially about the disc 111 so as to extend across the mouth of groove 116. Preferably, the disc 111 has a side wall **111*a* which extends axially relative to the axis of rotation of the disc and preferably the fingers 120 are located so their outer surfaces are substantially contiguous with the surface of the side wall 111*a***.

The disc 111 is positioned in use so as to be located adjacent to the dial 123 of points 12 of the linking machine so that on rotation of the dial 123 successive points 12 enter into the groove 16. The spacing between adjacent fingers 120 is chosen bearing in mind the gauge of points 12 such that on rotation of the dial 123 successive points 12 enter between adjacent fingers 120 and thereby cause the disc 111 to rotate.

In use fabric is impaled on the points 12 by an operative and then the dial is rotated to move the impaled fabric by the disc 111 prior to presenting the fabric to the sewing means (not shown) of the linking machine. Such rotation of the dial causes the fingers 120 to engage the fabric located between adjacent points and move the fabric down the shank of the points by a predetermined amount as the dial continues to rotate. In addition the fabric extending immediately above and below the points is engaged and moved by the outer surface of wall 111*a*.

The distance by which fabric is moved down the shank of the points is predetermined and adjusted by varying the closest distance d between the peripheries of the dial 123 and disc 111. This may conveniently be done by appropriate positioning of base 118. The depth and width of groove 116 are chosen to accommodate for adequate clearance for passage of the points through the groove.

Conveniently the fingers 120 are formed from lengths of wire which are fixedly located in axially extending grooves formed in the side wall 111*a*.

Figure 4:
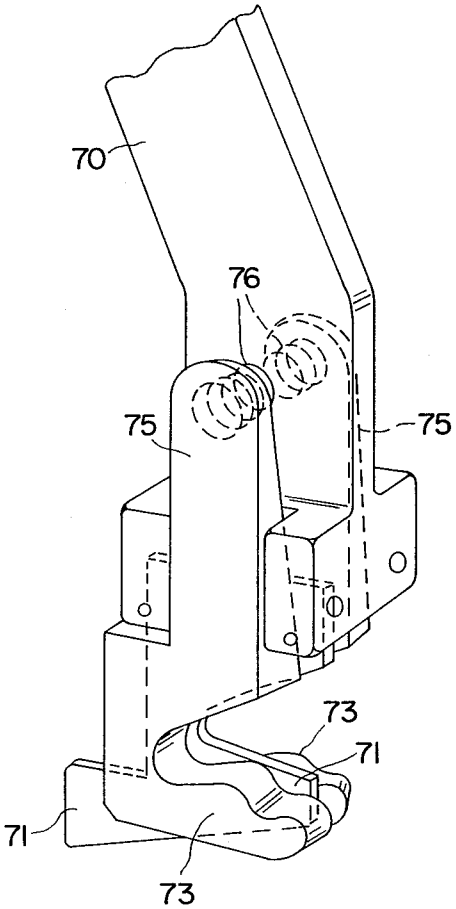
FIG. 4 is a more detailed part perspective view of the fabric uncurling device of the present invention.

The uncurling guide device 34 is more clearly illustrated in FIG. 4 and includes a support arm 70 which at one end is pivotally attached to the housing 100 of the first sewing station.

A central fixed blade 71 depends from the support arm 70 and is sandwiched between a pair of movable uncurling blades 73. Only one of the blades 73 is clearly visible in FIG. 4: it is to be appreciated however that both blades 73 are of the same construction.

Each blade 73 is integrally formed at one terminal end of a respective cranked arm 75 which is pivotally attached to the support arm 70. A spring 76 is located between an arm 75 and the support arm 70 so as to bias the blade 73 associated with arm 75 into engagement with the central blade 71.

The central blade 71 and each blade 73 have a leading edge which is contoured to achieve the desired uncurling action on fabric. In use, the marginal edge portion of one piece of fabric is located between the fixed blade 71 and one of the blades 73 with the curled edge facing outwards and the marginal edge portion of the other piece of fabric is similarly located between the fixed blade 71 and the other of the blades 73. The fabric located between respective blades 73 and the central blade 71 is resiliently gripped by virtue of the bias of springs 76.

As seen in FIG. 2, an adjustable height stop 78 is preferably provided which is secured to the support arm 70 by a bolt 79 passing through a slot formed in the stop 78. The stop 78 has a lower reference stop edge 80 against which the uncurled fabric edge emerging from the curler abuts and therefore sets the height of the edge of the fabric relative to the points 12.

In order to join together raw edges of pieces of fabric, the uncurling device 34 is moved to reside in its inoperative position. The pieces of fabric to be joined are impaled along points 12 upstream of the push-on device 32. Markers 35 are preferably provided for providing reference points for ensuring the correct length of the seam to be produced and for facilitating alignment of the pieces of fabric.

The linking machine is then activated causing the dial of points to revolve and in so doing convey the impaled pieces of fabric past the push-on device 32. The push-on device 32 acts to push the fabric pieces down the shanks of the points to a predetermined desired location and in readiness for being acted upon by the first sewing station.

In order to convert the linking machine so as to be capable of joining together pieces of fabric along respective selvedges the uncurling device 34 is moved to its operative position. Respective edges of the pieces of fabric are fed into the uncurling device 34 and a leading portion of the fabric is impaled on the points 12 adjacent to the push-on device 32. The linking machine is then activated causing rotation of the dial of points 12. Such rotation of the dial of points 12 causes the fabric pieces to be pulled by the points through the uncurling guide. During such movement of the fabric, the guide 34 serves to uncurl the fabric edges and direct them between the push-on device 32 and the dial of points 12. Rotation of the push-on device 32 ensures a smooth transition in movement of the fabric edges as they are presented to and pushed down the shanks of the points. In addition, since the blades 73, 71 grip the fabric edges the fabric between the uncurling device and the points 12 is tensioned. This ensures that the edges remain uncurled before being impaled onto the points 12. The operative position of the uncurling device is defined by the support 70 abutting a stop 85 (shown in FIG. 1). The stop 85 is adjustable to enable the operative position to be moved nearer to or further from the nip region between the push-on device 32 and the points 12.

As indicated above the uncurling device includes movable fabric edge height stops which serve to accurately locate the height of the edges of the fabric relative to the dial of points 12 as the fabric is drawn through the guide device 34.

I claim:

1. A fabric feed-on apparatus for a linking machine having a rotatable dial of points, the device including a fabric push-on device mounted on the linking machine adjacent to said points for meshing with said points and operable to push fabric onto and down the shanks of the points during rotation of the dial of points, and a fabric uncurling device movably mounted on the linking machine for movement between an operative position and an inoperative position, the uncurling device in said operative position being located adjacent to and upstream with relation to the movement of the rotatable dial of the push-on device so as to be able to guide and uncurl fabric edges to the push-on device during rotation of the dial of points to thereby cause the fabric edges to be impaled on the points, the uncurling device in said inoperative position being located at a remote stowed location so as to provide clear access to the dial of points.

2. A fabric feed-on apparatus for a linking machine having a rotatable dial of points, the device including a fabric push-on device mounted on the linking machine adjacent to said points for meshing with said points and operable to push fabric onto and down the shanks of the points during rotation of the dial of points, the push-on device comprising a rotatable disc having a circumferential periphery for engaging said fabric to push the fabric onto and down the shanks of the points, and a fabric uncurling device mounted on the linking machine so as to be able to guide and uncurl fabric edges to the periphery of said disc to thereby maintain the edges in an uncurled condition and cause them to be impaled on the points.

3. An apparatus according to claim 1 wherein the uncurling device includes a pair of movable uncurling blades located either side of a central fixed blade, biasing means being provided for urging the movable blades into contact with the central fixed blades.

4. An apparatus according to claim 3 wherein the uncurling device includes an adjustable height stop arranged to engage the uncurled edges of the fabrics to thereby define the height of the uncurled edge relative to the dial of points.

5. A device for running fabric down the shank of points having projecting terminal ends on a linking machine, the device including a plurality of spaced fingers arranged side by side on a movable support having an axis of rotation, the fingers being arranged in use substantially parallel to said axis of rotation and substantially perpendicular to said points at a distance from said axis which is greater than the distance between said axis of rotation and the terminal end of the points so that said fingers move along a path passing in board of the terminal end of the points such that each finger passes between an adjacent pair of points to thereby push fabric located on those points down their shanks.

6. A device according to claim 5 wherein the movable support is rotatable disc and the fingers are arranged concentrically relative to the axis of rotation of the disc.

7. A device according to claim 6 wherein the disc is freely rotatable and is mounted adjacent the dial of points of a linking machine such that on rotation of the dial of points, successive points penetrate between adjacent fingers and thereby cause the disc to rotate.

8. A device according to claim 6 wherein the outer periphery of the fingers and the disc are contiguous so that both the fingers and periphery of the disc engage the fabric to be run down the points.

9. A device according to claim 8 wherein the disc has a circumferentially extending groove which enables the points of the linking machine to pass therethrough, the fingers being located so as to extend across the mouth of the groove.

10. A device according to claim 8 wherein the outer periphery of the disc is provided with axially extending grooves in which the fingers are located.

11. An apparatus according to claim 2 wherein the uncurling device includes a pair of movable uncurling blades located either side of a central fixed blade, biasing means being provided for urging the movable blades into contact with the central fixed blades.

12. A device according to claim 7 wherein the outer periphery of the fingers and the disc are contiguous so that both the fingers and periphery of the disc engage the fabric to be run down the points.

13. A device according to claim 9 wherein the outer periphery of the disc is provided with axially extending grooves in which the fingers are located.

14. A device according to claim 12 wherein the outer periphery of the disc is provided with axially extending grooves in which the fingers are located.

* * * * *